United States Patent [19]

Galer

[11] 4,298,132

[45] Nov. 3, 1981

[54] CHILD-PROOF LID AND PAIL ARRANGEMENT

[75] Inventor: Herbert W. Galer, Newnan, Ga.

[73] Assignee: United States Steel Corporation, Pittsburgh, Pa.

[21] Appl. No.: 132,738

[22] Filed: Mar. 24, 1980

[51] Int. Cl.[3] ..... B65D 41/04

[52] U.S. Cl. ..... 220/288; 220/304; 220/74; 220/72; 215/217

[58] Field of Search ..... 220/288, 304, 72, 74; 206/521; 215/216, 217

[56] References Cited

U.S. PATENT DOCUMENTS

| | | | |
|---|---|---|---|
| 2,827,193 | 3/1958 | Martin | 215/217 |
| 3,924,769 | 12/1975 | Fillmore | 215/216 |
| 3,998,355 | 12/1976 | Galer | 220/304 |

*Primary Examiner*—George T. Hall

*Attorney, Agent, or Firm*—William A. Danchuk; William L. Krayer

[57] ABSTRACT

This invention concerns plastic lids and pails having improved child-proof locking features. Intermittently placed teeth-like elements located on the pail and lid interlock to prevent the easy opening of the assembled pail and lid.

4 Claims, 6 Drawing Figures

FIG. 2
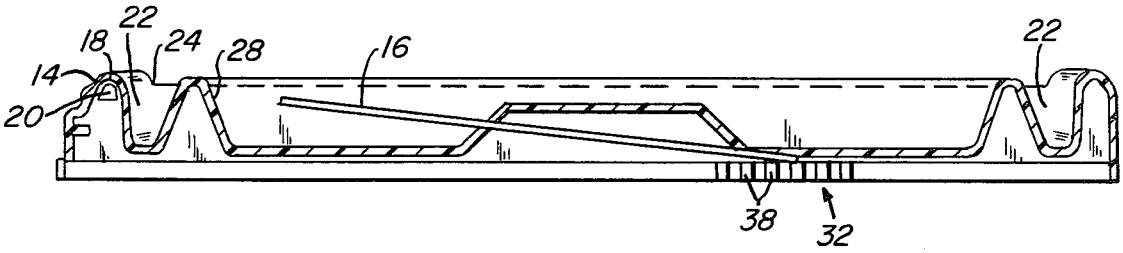
FIG. 3
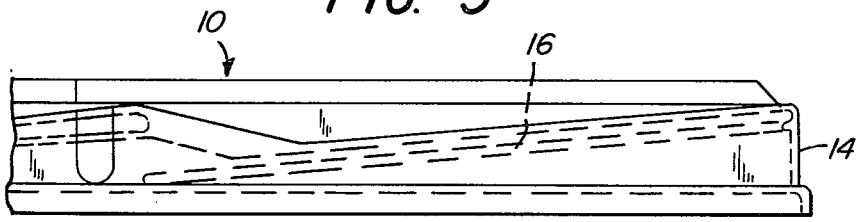
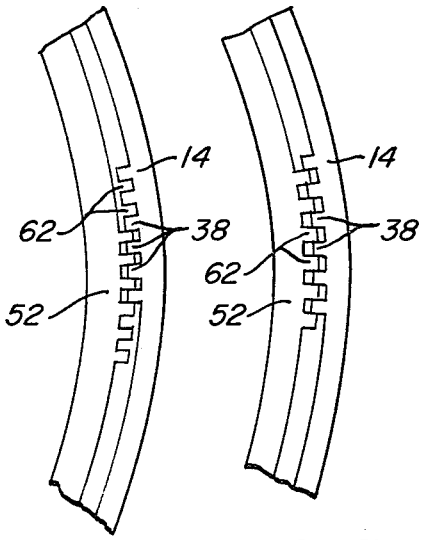
FIG. 5b FIG. 5a

CHILD-PROOF LID AND PAIL ARRANGEMENT

BACKGROUND OF THE INVENTION

Large thick-walled plastic containers are used for packaging and transporting materials in the form of liquids and solids. These materials may be solids, liquids or pastes, aqueous or organic, acidic or alkaline, e.g., detergent solutions, latices, foods or condiments, fine chemicals, etc., which may be poisonous. Two and one-half, five- and six-gallon sizes are most common. Because of inertness and toughness, plastics such as high density polyethylene or other inert moldable thermoplastic resins are preferred materials. The containers are filled with the contents, capped, perhaps stored, and shipped. After they are transported to the user, he may also store them. In storage, these containers are stacked one upon the other. After being opened, they may be reopened and closed as the contents are used. There are two common types of container constructions: the wide mouth or open-head pail and the closed mouth or tight-head pail. This invention relates to constructions for open-head pails so that they may have the structural characteristics associated with tight-head pails yet retain the wide mouth access of the open-head pails and yet remain child-proof.

SUMMARY OF THE INVENTION

In this invention, there is an improved lid and pail interface construction for resisting opening by children when the pails are closed fully or partially. This is obtained by having areas of plastic teeth located at different sections along the periphery of both the pail and lid which periodically engage each other along various arcs on the outer diameter of the pail. The teeth on the lid are placed out of phase with the teeth located on the pail to enable engagement at various positions of the lid during both closing and opening. These features are applied to lids having screw threads as engagement means between the lid and the pail and to pails having reinforced top portions.

Accordingly, it is a general object and feature of the present invention to provide an improved lid and pail child-proof interface.

It is another object and feature of the present invention to provide a child-proof lid and pail construction for an open-head pail including interlocking elements provided on both the pail and the lid.

It is another object and feature of the present invention to provide a child-proof lid and pail construction for an open-head pail including interlocking elements provided about peripheral portions of the pail and lid such interlocking elements being positioned out of phase with one another for providing child-proof engagement without the lid being fully closed on the pail.

Other objects and features of the present invention will, in part, be obvious and will, in part, become apparent as the following description proceeds. The features of novelty which characterize the invention will be pointed out with particularity in the claims, annexed to and forming part of the specification.

BRIEF DESCRIPTION OF THE DRAWINGS

The novel features which are considered characteristic of the invention are set forth with particularity in the appended claims. The invention itself, however, both as to its structure as well as its operation together with the additional objects and advantages thereof will best be understood from the following description of the preferred embodiment of the present invention when read in conjunction with the accompanying drawings wherein:

FIG. 2 is a cross section in elevation of a lid shown in FIG. 1 according to this invention with portions cut away to reveal internal detail.

FIG. 3 is an elevation in full of a quarter section of the lid shown in FIG. 1.

FIG. 5*a* is a bottom view of an enlarged portion of the interface between the lid of FIG. 1 combined with the pail of FIG. 4 in a closed and locked position; and FIG. 5*b* is a bottom view of an enlarged portion of the interface between the lid of FIG. 1 combined with the pail of FIG. 4 in another closed and locked position.

DETAILED DESCRIPTION OF THE INVENTION

Figure 1:
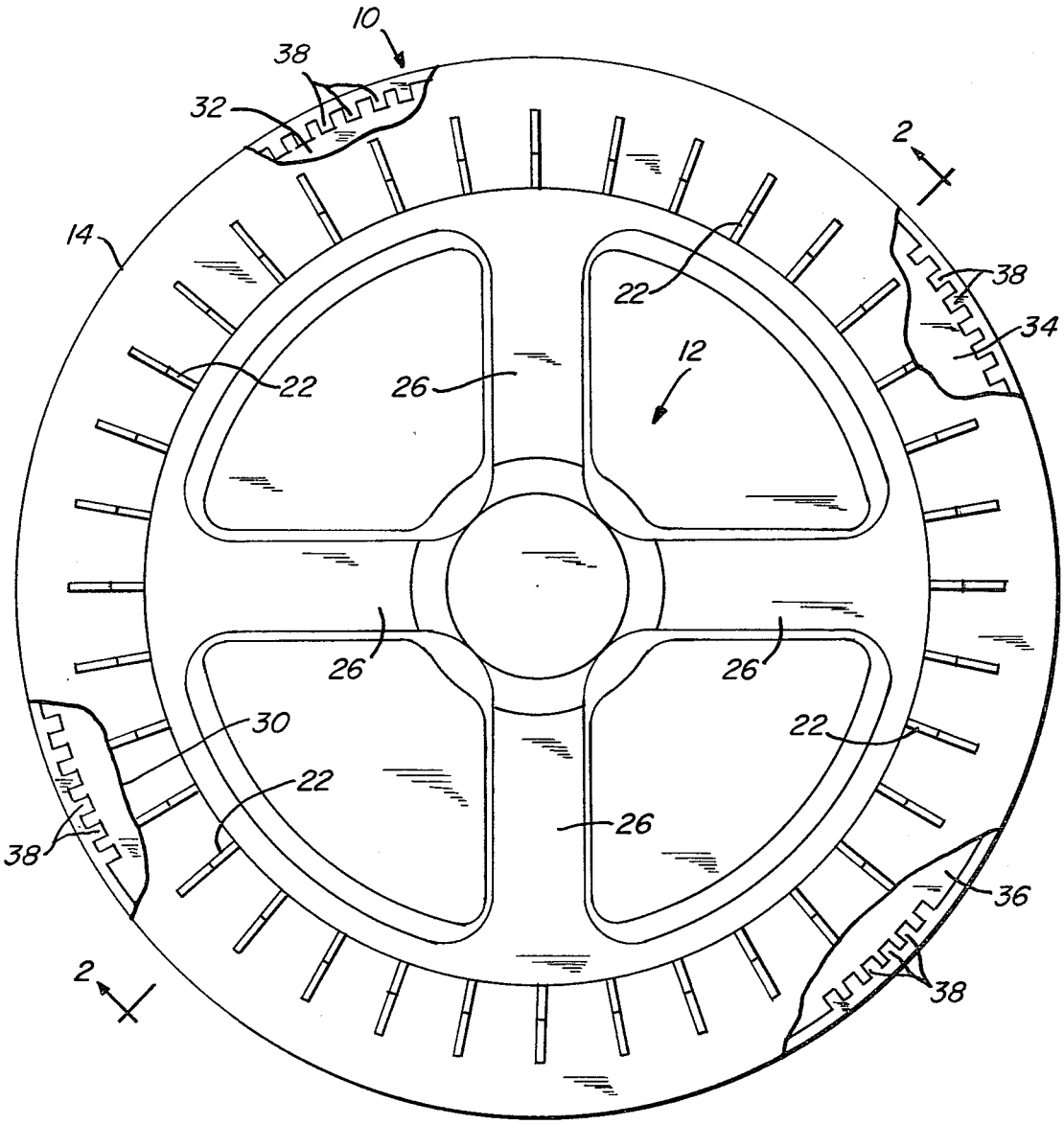
FIG. 1 is a plan view of a lid with portions cut away to reveal internal detail.

Plastic containers constructed in accordance with this invention comprise a pail or receptical body and a lid with a gasket contained therein. The lid is securely fastened to the pail, while the gasket forms the seal between the lid and the pail. The pail is configured having an opening at its top substantially the width of the pail, and includes fastening mechanisms located at or near the top of the pail. The lid covers the open top of the pail and has fastening mechanisms located about its periphery to cooperate with the mechanisms on the pail for securing the lid to the pail in a child-proof manner. Looking to FIGS. 1, 2 and 3, the lid structures of the present invention are illustrated. The plastic lid 10 has a central closing portion 12. An inverted U-shaped rim 14 surrounds the central closing portion 12. The rim 14 contains a plurality of engagement threads, one of which is shown at 16, along its inside periphery for fastening the lid 10 to an openhead pail through threads located on the pail as will be discussed below. The interior of the rim as at 18 is shaped to accept a gasket 20 which provides a seal between the lid and the pail when the two are joined. Radially projecting about the rim are a plurality of thin plastic members 22. These members are located inwardly from the outer periphery of the rim as shown in FIGS. 1 and 2. The thin plastic members 22 are provided for initially absorbing and dissipating impact forces directed to the rim of the lid. This absorption distributes the shock of such impact over a broad region of the lid thereby causing a reduction in the intensity of force per unit area so that the seal formed by the combination of lid, gasket and pail will be able to maintain its sealing integrity after such shock. The thinness and spacing of the upstanding members is selected according to the mass of the container and the curvature of the rim. These members are configured to be thin enough and long enough so that upon impact they deflect rather than rigidly transmit the forces to the rim itself. For further details regarding the location and operation of the thin plastic members 22, reference should be made to the following U.S. Pat. Nos. 4,034,886 and 4,126,246. It should be noted, however, that the elements 22 have a cut-down portion 24 which permits the convenient stacking of such units upon another in a retained relationship. Central closing portion 12 includes four elevated spoke elements 26 extending radially outwardly from the center of the lid. They terminate in a centrally located ridge 28 prior to the location of the thin plastic members 22 and the outer rim 14.

As previously noted, there are a plurality of engagement threads 16 located along the inside periphery of the lid 10 which provide, in combination with complementary configured structures on the barrel top, for the screw-down operation of the lid with respect to the pail. This threaded feature 16 may be seen in FIGS. 2 and 3, the latter showing it in dotted lines.

Periodically positioned about the inner periphery of the lower portion of the lid 10 are a plurality of areas 30, 32, 34 and 36, each containing a plurality of inwardly directed teeth 38. These teeth, as will be seen below, are configured to cooperate with similar teeth formed on the outer top periphery of the pail rim for providing one function of the dual function child-proof features of the present invention. Before describing the pail in detail, it should be appreciated that the positioning of the teeth in the areas 30, 32, 34 and 36 is made such that these areas are out of phase with the positioning of the areas of teeth located on the pail. In the latter case, the areas of teeth are placed substantially 90° from each other while the areas of teeth located on the periphery of the inside of the lid 10 (as may be seen in FIG. 1) are specifically placed out of phase and do not necessarily exist at a 90° relationship along the rim circumference with one another. The purpose for such out-of-phase location of the toothed areas will be explained in greater detail below.

Figure 4:
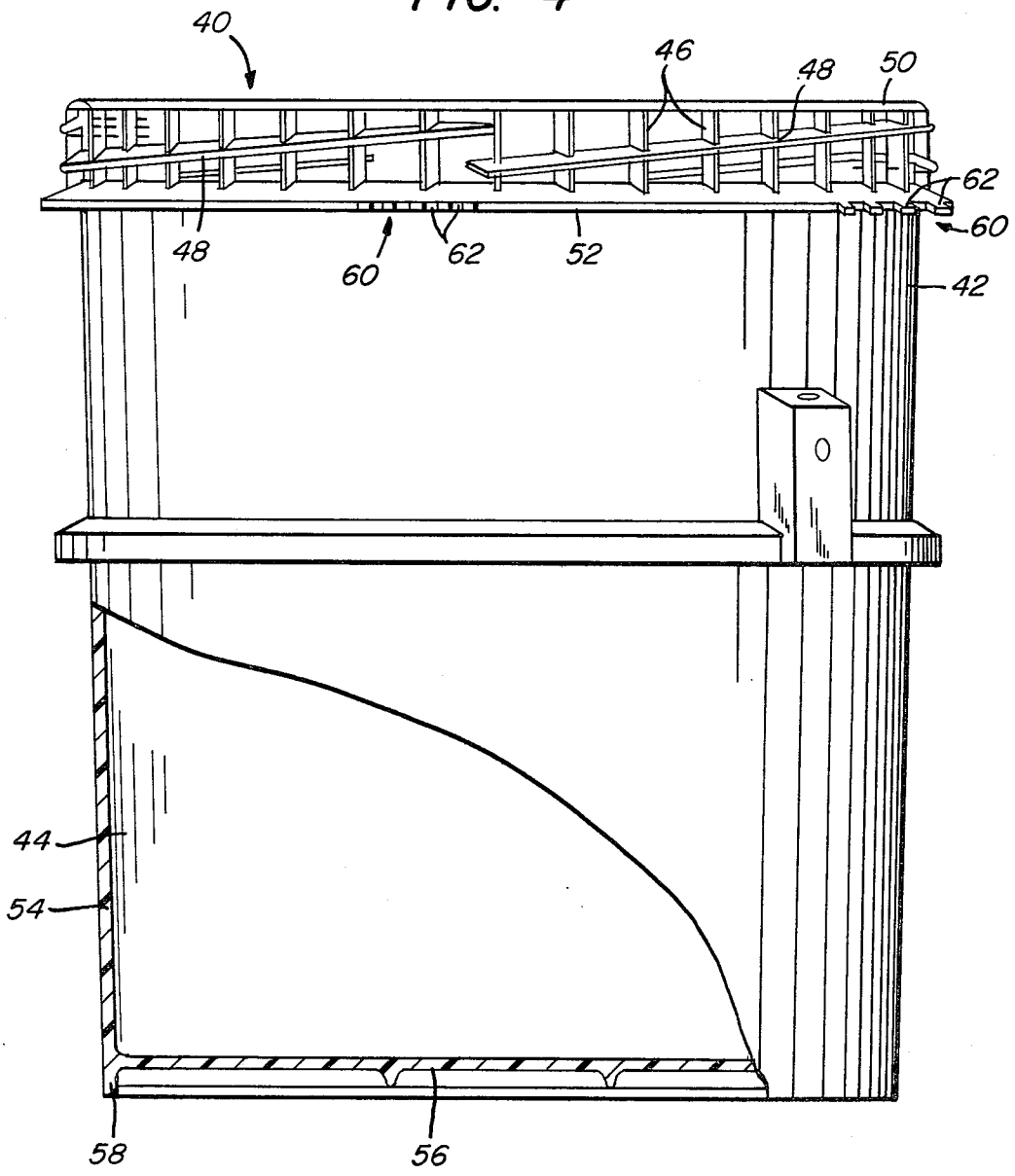
FIG. 4 is an elevation, partly in cross section, of a plastic pail according to this invention.

The detail elements of the pail itself will be best appreciated by referring to FIG. 4 wherein a plastic pail or receptical body is shown. As shown in FIG. 4, the pail 40 has a topmost section 42, and a bottom section 44. The topmost section 42 contains the matching engagement elements for the lid located at the mouth of the pail. Reinforcing members 46 in the form of thin integrally molded elements extending outwardly from the outer side wall of the pail to the mid region of the engagement elements and extending through the vertical section of the topmost section can be used with the engagement elements in the form of screw threads as at 48. The members 46 tend to stiffen the topmost section of the pail against deflection and impact forces and transfer or distribute such deflection to the lower portions of the pail. When used with screw threads 48 it is preferred that the reinforcement members 46 extend into the screw thread a distance sufficient to reduce deflection of the individual thread. The thread 48 can extend outwardly of the rim 50 of the pail and, as a consequence, the interior of the arch in the lid and the arrangement of the top section of the pail can be dimensioned so that the engagement elements on the lid and pail are mated at a position that is exterior of the rim 50 of the pail. The reinforcing members 46 on the pail may be oriented in the direction of draw of the mold which forms the pail. Then, these members will form an acute angle with a radius through the axis of the pail which passes through the inner section of the pail and the members. The reinforcing members are arranged to form a stiff reinforcing action in the topmost section of the pail without a substantial mass of plastic being present. A preferred assembly includes the extension of the vertical members 46 downwardly from the top of the pail to a peripheral shoulder 52 extending outwardly from the pail. The threaded elements 48 are disposed as a helix along the pail axis and extend from the top of the pail to the peripheral shoulder.

The bottom section 44 of the pail has a vertical side wall section 54 and a horizontal bottom wall section 56 which is disposed above the lower edge 58 of the side wall section 54. The lower edge 58 of the side wall section is shaped to repose within the peripheral rim of a lid similar to that described above. The particular dimensions features an operation of the lid and pail which are not directly associated with the present invention can best be had by reference to U.S. Pat. No. 4,034,886 by Herbert W. Galer and assigned to the assignee of the present invention.

Disposed about the periphery of the peripheral rim 52 of the pail 40 are a plurality of toothed areas 60 which, as indicated above, are cooperative with the toothed areas 30, 32, 34 and 36 of the lid 10. As alluded to previously, the toothed area 60 provided on the pail 40 are located along the peripheral rim 52 at angles of 90° with respect to one another with regard to the axis of the pail. The teeth 62 forming the toothed areas 60 are of a size, shape and configuration to enable their mating with the teeth and voids provided by teeth 38 of lid 10.

In operation, the lid 10 is placed over the top of the pail 40 and the rim 50 and the lid 10 is rotated in a clockwise direction (a righthand thread direction) until the indent or ramp thread 16 engages the male portion of the thread 48 on the pail. Further rotation of the lid in the clockwise direction moves the lid 10 downwardly as the threaded portions engage each other. When the pail lid 10 has been threaded down almost to the full extent of its possible travel through the engagement of the male thread portion 48 with the female thread portion 16, the toothed areas 30, 32, 34 and 36 are in an elevation in which they may engage the toothed areas 60 on the peripheral rim 52 of the pail 40. Further rotation of the pail lid with respect to the pail 40 moves at least one toothed area of the lid into engagement with at least one toothed area 60 of the pail. The lid is now in a position in which it has bottomed out on the threaded portions discussed above and is in a tooth engaged relationship wherein further clockwise rotation of the lid relative to the pail becomes difficult if not impossible. When in this condition the lid is in a closed and locked relationship with respect to the pail and is "child-proof".

Any attempt by a child to open the pail or receptacle by rotating the lid in a counter-clockwise direction is prevented by the engagement of the toothed portions of the lid with the toothed portions of the pail. It should be noted in this regard that due to the placement of the toothed areas 30, 32, 34 and 36 on the lid in an out-of-phase relationship discussed above, that engagement between the two sets of teeth will occur during substantial portions of both the closing and opening operation.

Looking to FIGS. 5*a* and 5*b*, there is shown a bottom view of two states of engagement between the toothed areas of the lid with the toothed areas of the pail. FIG. 5*a* shows a full engagement between the two toothed areas such that the teeth 38 are engaged fully by the teeth 62 along the full length of both areas. FIG. 5*b* shows a partial engagement of three or four teeth between each of the areas which have been shown to be sufficient to preclude the opening of the pail by a child. Full engagement of the full set of teeth on the lid and the pail is not necessary for preventing this latter opening, thereby providing for a child-proof closure in either case.

Consequently, there is provided an insurance against a child overriding one of the toothed engagements at one portion of rotation, i.e., engagement will be realized during subsequent portions of the opening operation by a child attempting to open the receptacle. By the same token, the child is precluded from accidentally opening the receptacle by prying off the lid due to the continuous threaded engagement between the threaded elements on the pail and the lid.

In conclusion, it can be seen that there is provided a safe, simple and economical child-proof structure to a relatively large plastic receptacle which may contain dangerous chemicals to both adults and children. The configuration of the threads and toothed portions provided on the pail and lid permit an adult to provide sufficient force to open the receptacle while precluding a child from accidentally opening the pail by either rotating the lid or by prying off the lid. It should also be seen that due to the provision of the outer phasing of the toothed areas on either lid or the pail, that there is provided a plurality of engagements throughout the opening operation which may be easily overcome by an adult but which may not by a child.

While certain changes may be made in the above-noted pail and lid combination without departing from the scope of the invention herein involved, it is intended that all matter contained in the above description or shown in the accompanying drawings shall be interpreted as illustrative and not in a limiting sense.

I claim:

1. In a stiff molded plastic pail and lid therefor, said lid having an inverted U-shaped rim containing threaded portions and configured to fit over and receive the upper periphery of said pail, said pail having threaded portions about its outer upper periphery for mating with said threaded portions of said lid, the improvement comprising:

first engagement means comprising a first plurality of toothed areas located on the inner wall of said lid rim, said toothed areas extending radially inwardly from said inner wall toward the center of said lid; and second engagement means comprising a second plurality of toothed areas, configured to releasably mate with at least a portion of said first plurality of toothed areas, said second toothed areas being located along the upper outer periphery of said pail, but out of phase with respect to said first plurality of toothed areas extending radially outwardly and at least a portion thereof being matable with said first engagement means when said lid is threaded down upon said pail for preventing rotation of said lid with respect to said pail by a child, the threaded engagement between said pail and said lid preventing prying off of the latter by a child, whereby the pail and lid are child-proof when closed.

2. The apparatus according to claim 1 wherein said toothed areas located on said lid or said pail are located at varying unequal spacing intervals from each other about the circumference of the lid rim or pail rim for providing an engagement between the toothed areas of the lid with those of the pail which varies in phase as said lid is rotated with respect to said pail for ensuring intermittent engagement between said first and second engagement means whereby a child is prevented from opening said lid with respect to said pail.

3. The apparatus according to claim 1 wherein said second engagement means includes four toothed areas equally spaced about the circumference of the pail rim, said first engagement means including four toothed areas nonequally spaced about the circumference of the inner wall of said lid rim for providing said intermittent engagement between said first and second engagement means when said pail is closed by said lid and opening rotation of the latter is attempted, thereby providing a child-proof closure even when said lid is not fully closed.

4. The apparatus according to claim 1 wherein said first engagement means includes four toothed areas equally spaced about the inner wall of the lid rim, said second engagement means including four toothed areas nonequally spaced about the circumference of the pail rim for providing said intermittent engagement between said first and second engagement means when said pail is closed by said lid and opening rotation of the latter is attempted, thereby providing a child-proof closure even when said lid is not fully closed.

* * * * *